US009123263B2

(12) United States Patent
Maman et al.

(10) Patent No.: US 9,123,263 B2
(45) Date of Patent: Sep. 1, 2015

(54) MODULAR CHANGEABLE INSERTS FOR SIGNS

(71) Applicants: Israel Maman, Naharyia (IL); Reuven Maman, Naharyia (IL)

(72) Inventors: Israel Maman, Naharyia (IL); Reuven Maman, Naharyia (IL)

( * ) Notice: Subject to any disclaimer, the term of this patent is extended or adjusted under 35 U.S.C. 154(b) by 0 days.

(21) Appl. No.: 14/293,322

(22) Filed: Jun. 2, 2014

(65) Prior Publication Data

US 2014/0373410 A1 Dec. 25, 2014

Related U.S. Application Data

(60) Provisional application No. 61/830,107, filed on Jun. 2, 2013.

(51) Int. Cl.

| | |
|---|---|
| ***G09F 7/04*** | (2006.01) |
| ***G09F 7/18*** | (2006.01) |
| ***G09F 15/00*** | (2006.01) |

(52) U.S. Cl.

CPC ..... *G09F 7/18* (2013.01); *G09F 15/0068* (2013.01); *G09F 7/04* (2013.01); *G09F 2007/1843* (2013.01); *G09F 2007/1852* (2013.01); *Y10T 29/49947* (2015.01)

(58) Field of Classification Search

CPC ..... G09F 7/04
USPC ..... 40/600, 611.01
See application file for complete search history.

(56) References Cited

U.S. PATENT DOCUMENTS

| | | | | |
|---|---|---|---|---|
| 2,006,573 | A * | 7/1935 | Isenhour | 40/606.13 |
| 4,817,316 | A * | 4/1989 | Walker | 40/576 |
| 4,884,352 | A * | 12/1989 | Lipscomb | 40/611.01 |
| 5,901,486 | A * | 5/1999 | Sharon et al. | 40/618 |
| 6,182,387 | B1 * | 2/2001 | Duguay | 40/621 |
| 7,194,831 | B1 * | 3/2007 | Cullinan | 40/568 |
| 7,373,747 | B1 * | 5/2008 | Wiemer et al. | 40/605 |
| 2011/0113661 | A1 * | 5/2011 | Pemberton | 40/541 |
| 2014/0196330 | A1 * | 7/2014 | Cook et al. | 40/594 |

* cited by examiner

*Primary Examiner* — Gary Hoge
(74) *Attorney, Agent, or Firm* — William H. Dippert; Eckert Seamans Cherin & Mellott, LLC

(57) ABSTRACT

A modular sign inserts system that comprises a back panel onto which at least two insert panels are adjacently arranged is provided. Each insert panel has a front side and a back side wherein the back side is placed onto the back panel and the front side displays information. The system further comprises at least one partition to be removably placed between two adjacent insert panels wherein the back side of the insert panels is removably connected to the back panel. The system can also be provided with a plurality of connectors attached to the back side for connecting the insert panels to the back panel.

20 Claims, 11 Drawing Sheets

MODULAR CHANGEABLE INSERTS FOR SIGNS

CROSS-REFERENCE TO RELATED APPLICATION

The present application is based upon and claims the priority of U.S. Provisional Patent Application Ser. No. 61/830,107 filed Jun. 2, 2013, entitled "Modular Changeable Inserts for Signs," incorporated herein by reference in its entirety.

FIELD OF THE INVENTION

The present invention relates to signs exhibiting information. More particularly, the present invention relates to modular changeable inserts for signs.

BACKGROUND OF THE INVENTION

Typical signs, for exhibiting information, are found in public buildings (e.g., hospitals) or in commercial buildings (e.g., company offices). These signs are usually fixedly positioned adjacent to a door or a wall, with information indicating details of a specific department (e.g., accounting) or a person (for example, the name and position or title). A single sign can also be modular and comprise several sections, each for a specific subject, for example, a sign listing different departments in a hospital or a sign listing the names of people working in the accounting department.

As changes constantly occur in these buildings (due to personnel change, for instance), the information on the signs needs to be changed accordingly, and thus the entire sign should be replaced. For example, a sign listing five people working in the human resources department is replaced with a new sign when only one member of the staff is replaced.

There is therefore a need for a changeable sign solution, having sections that can be easily changed separately, with the sign rearranged according to specific changes or needs.

SUMMARY OF THE INVENTION

It is therefore provided in accordance with an embodiment of the present invention, a modular sign inserts system that comprises:

a back panel;

at least two insert panels adjacently arranged on said back panel, each insert panel having a front side and a back side wherein said back side is placed onto said back panel and said front side of at least one of said at least two insert panels displays information; and at least one partition to be removably placed between two adjacent insert panels;

wherein said back side of the insert panels is removably connected to said back panel.

Furthermore, in accordance with another embodiment, the modular sign system further comprises a plurality of connectors attached to said back side for connecting said at least one insert panel to the back panel.

Furthermore, in accordance with another embodiment, the back panel is metallic and said plurality of connectors is magnetic.

Furthermore, in accordance with another embodiment, the back panel is magnetic and said plurality of connectors is metallic.

Furthermore, in accordance with another embodiment, said back panel is metallic and said at least two insert panels are magnetic.

Furthermore, in accordance with another embodiment, the at least one partition comprises a base and a protrusive wall, and wherein the protrusive wall is positioned between said two adjacent insert panels.

Furthermore, in accordance with another embodiment, the base is configured to be positioned between the back side of the insert panels and the back panel.

Furthermore, in accordance with another embodiment, the at least one partition further comprises a cap.

Furthermore, in accordance with another embodiment, at least one of the insert panels has a different shape from other insert panel.

Furthermore, in accordance with another embodiment, at least one of the insert panels has a size that is different from the other insert panels.

Furthermore, in accordance with another embodiment, at least one of the insert panels has a color that is different from other insert panels.

Furthermore, in accordance with another embodiment, at least one partition has a size that is different from the size of other partitions.

Furthermore, in accordance with another embodiment, at least one partition has a shape different from shapes of other partitions.

Furthermore, in accordance with another embodiment, at least one partition has a color that is different from colors of other partitions.

It is furthermore provided in accordance with yet another embodiment, a method for assembling a changeable modular sign insert system, comprising:

providing a back panel;

providing at least two insert panels, each insert panel having a back side configured to removably connect to said back panel and a front side configured to display information;

adjacently arranging said at least two insert panels onto said back panel so that the back side is connected to said back panel; and placing at least one partition of a plurality of partitions between adjacent insert panels.

Furthermore, in accordance with another embodiment, the method further comprises providing a plurality of connectors attached to the back side of the insert panels wherein said plurality of connectors are removably connected to said back panel.

Furthermore, in accordance with another embodiment, said at least one partition comprises a base configured to be placed between the back side and the back panel and a protrusive wall that is positioned between adjacent insert panels.

Furthermore, in accordance with another embodiment, the method further comprising:

providing a replacement insert panel having a back side and a front side, wherein said front side displays information;

gripping one of the partitions adjacent to an insert panel to be replaced and removing it from between the adjacent insert panels so as to release the insert panel to be replaced from the back panel;

assembling the replacement insert panel to the back panel; and re-assembling said one of the partitions adjacent to the insert panel to be replaced.

Furthermore, in accordance with another embodiment, the back panel is metallic and the plurality of connectors is magnetic or vice versa.

In addition, there is provided in accordance with yet another embodiment, a modular sign inserts kit, comprising:

a back panel;

at least two insert panels, each insert panel having a back side and a front side, wherein at least one of said front side is configured to allow displaying information and said back side is removably connectable to said back panel; and at least one partition configured to allow separation between insert panels adjacently placed.

Furthermore, in accordance with another embodiment, the kit further comprises a plurality of connectors, each connector configured to allow attachment of the back side to the back panel.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. In case of conflict, the specification, including definitions, will control. In addition, the materials, methods, and examples are illustrative only and not intended to be limiting.

BRIEF DESCRIPTION OF THE DRAWINGS

Embodiments are herein described, by way of example only, with reference to the accompanying drawings. With specific reference now to the drawings in detail, it is stressed that the particulars shown are by way of example and for purposes of illustrative discussion of the preferred embodiments, and are presented in the cause of providing what is believed to be the most useful and readily understood description of the principles and conceptual aspects of the embodiments. In this regard, no attempt is made to show structural details in more detail than is necessary for a fundamental understanding of the invention, the description taken with the drawings making apparent to those skilled in the art how the several forms of the invention may be embodied in practice.

In the drawings.

DESCRIPTION OF THE PREFERRED EMBODIMENTS

Figure 1:
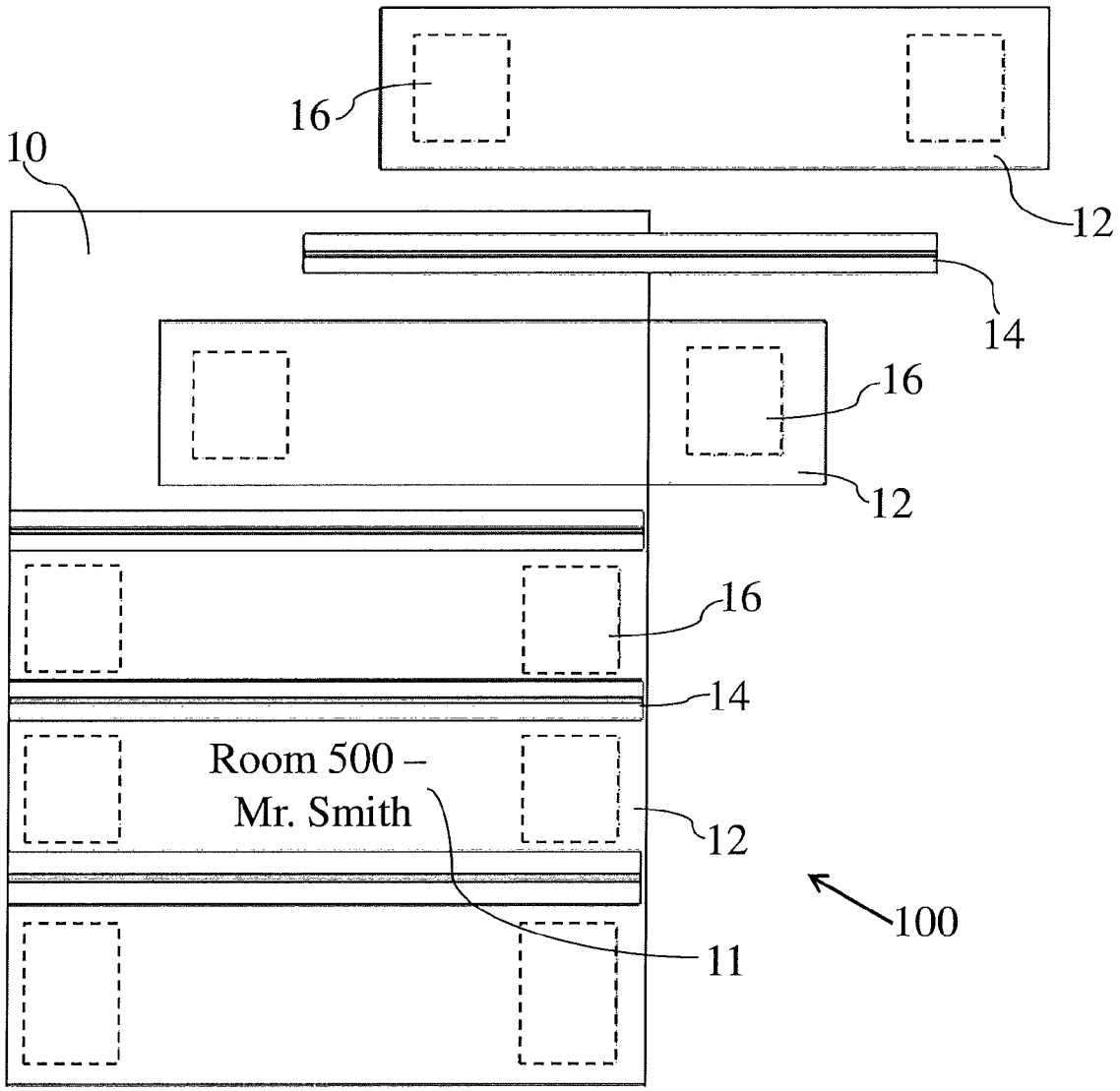
FIG. 1 schematically illustrates a frontal view of a modular changeable sign system, according to an exemplary embodiment.

Before explaining at least one embodiment in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

For clarity, non-essential elements were omitted from some of the drawings.

FIG. 1 schematically illustrates a frontal view of a modular changeable sign system 100, exhibiting information on insert panels 12. Each insert panel 12 displays different information 11, such as shown on one of the panels, on the front face of the insert panel 12. Each panel 12 is provided with connectors 16 (indicated with a dashed line), preferably magnetic, permanently fixed to the back of the insert panel 12 with an adhesive. The insert panels 12 can be connected to a back panel 10, preferably metallic, of the sign system 100, with the magnetic connectors 16 attached to the metallic back panel 10. Partitions 14 separate between the insert panels 12, so that an individual insert panel could be replaced with another insert panel when needed without disturbing the arrangement of the panels on the metallic back panel. Details of the partition will be provided hereinafter.

It should be clarified that although the example provided herein uses magnets for connectors 16, one can use other connectors available for connecting two surfaces such as Scotch tape systems or detachable adhesives without limiting the scope of the present invention.

In an additional embodiment, the back panel 10 is magnetic and the insert panels 12 are metallic.

Alternatively, the back panel is metallic, and the insert panels are made of a magnetic material or being incorporated with a magnetic material. In this case, the connectors are redundant.

Figure 2A:
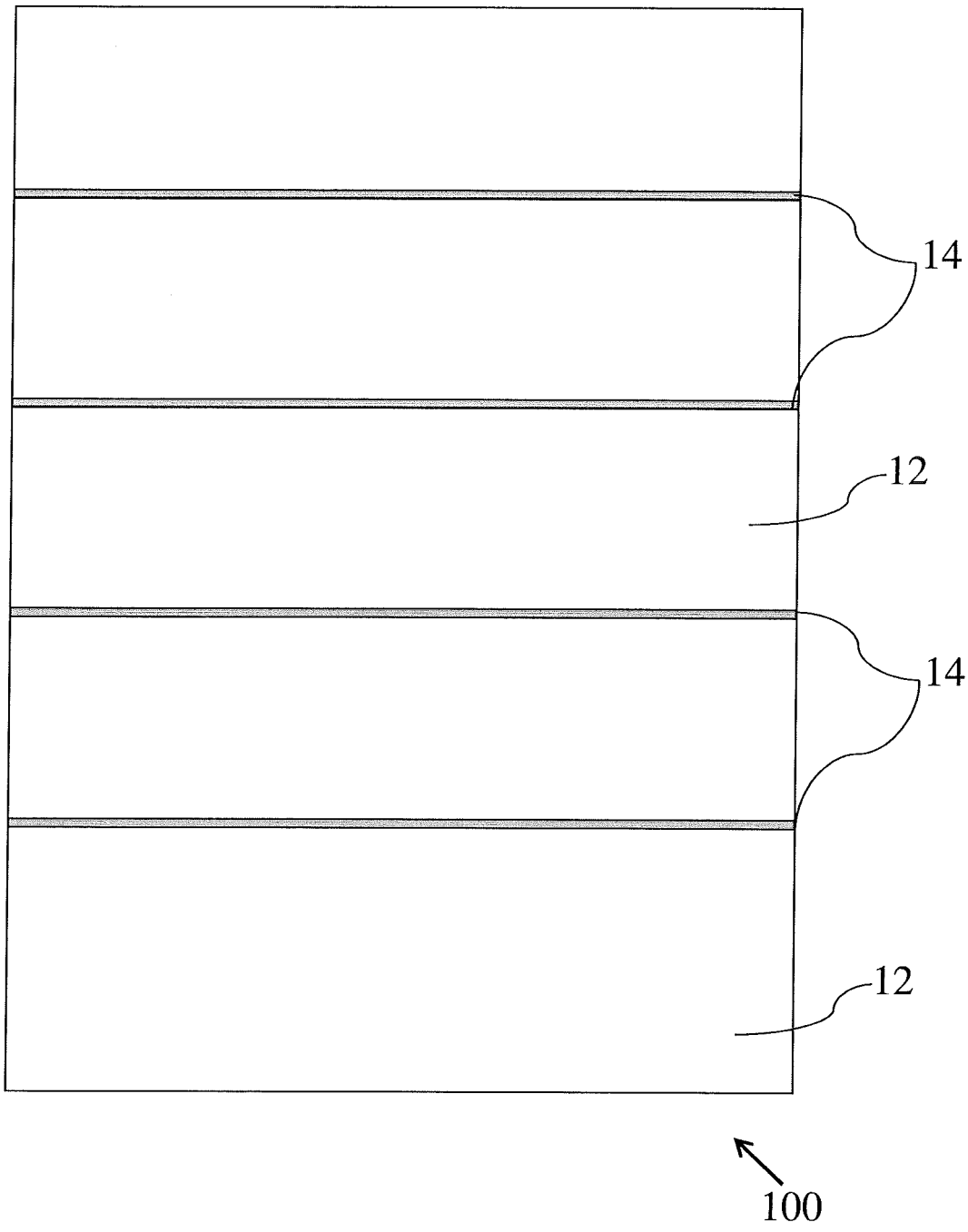
FIG. 2A shows a front view of the changeable sign system with all insert panels and partitions assembled, according to an exemplary embodiment.
Figure 2B:
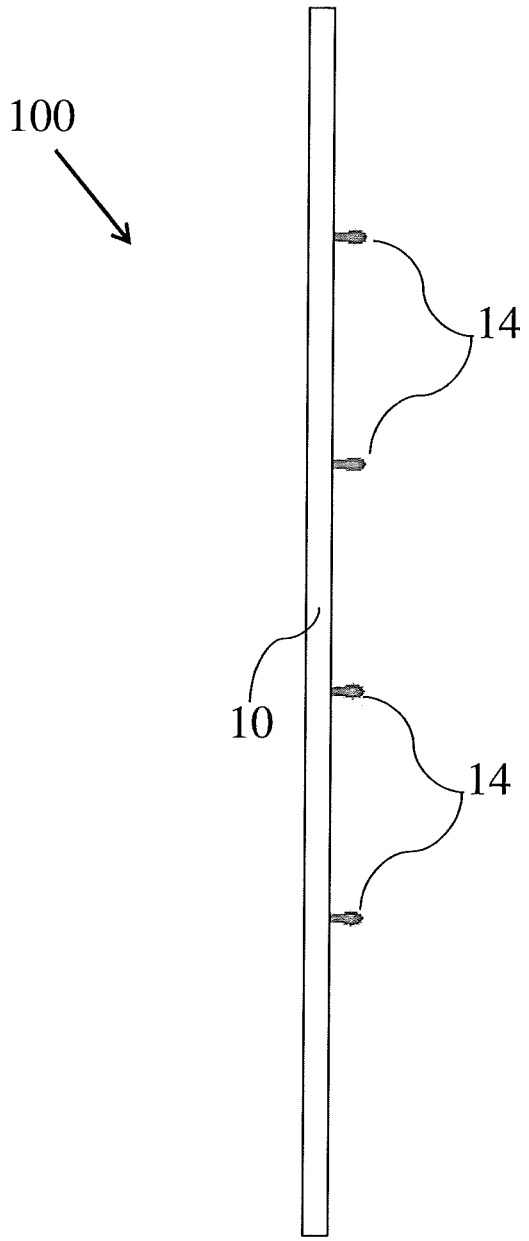
FIG. 2B shows a side view of the changeable sign system from FIG. 2A, according to an exemplary embodiment.

FIG. 2A and FIG. 2B show a front view and a side view, respectively, of the changeable sign system 100 with all insert panels 12 and partitions 14 assembled. It should be mentioned that information should appear on the panels in case of use, but is not shown in the figures.

Figure 3A:
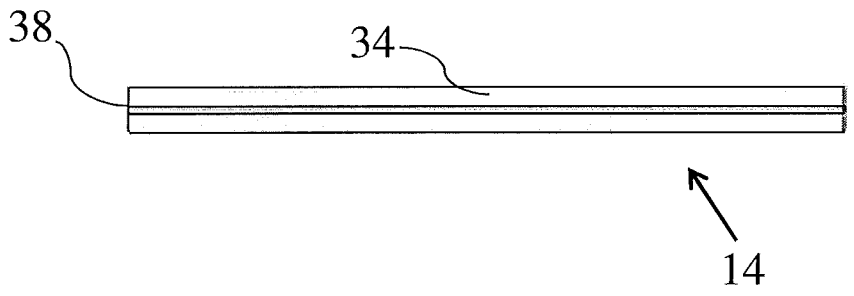
FIG. 3A shows a front view of the partition from FIG. 1, according to an exemplary embodiment.
Figure 3B:
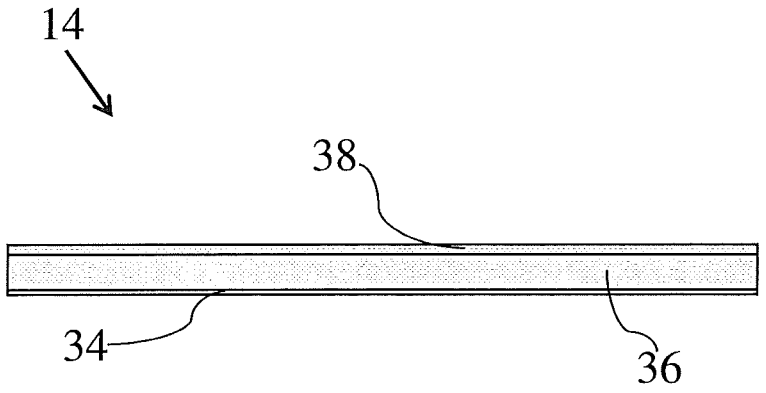
FIG. 3B shows a bottom view of the partition from FIG. 1, according to an exemplary embodiment.
Figure 3C:
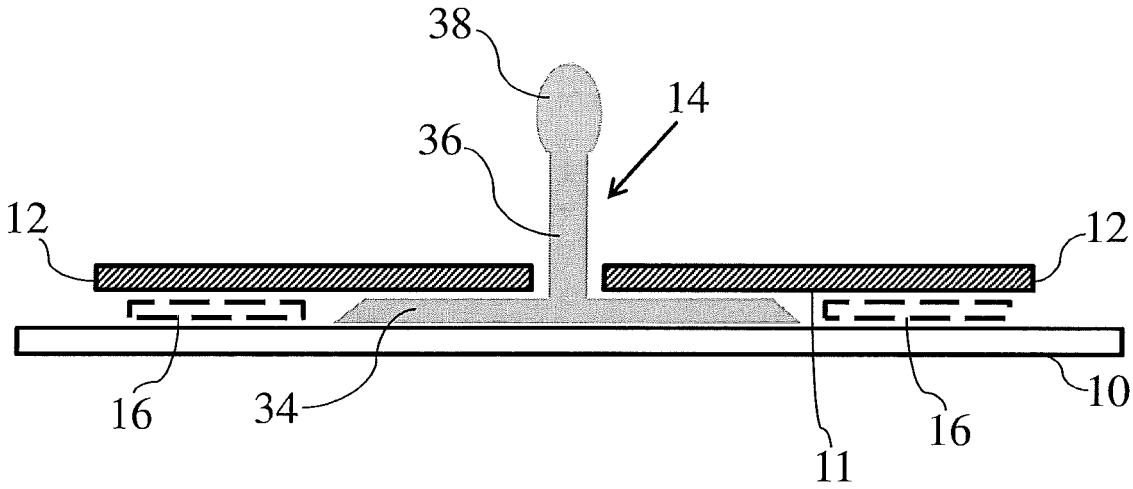
FIG. 3C shows a side view of the partition from FIG. 1 positioned between two insert panels, according to an exemplary embodiment.

FIG. 3A and FIG. 3B show a front view and a bottom view, respectively, of the partition 14. FIG. 3C shows a side view of the partition 14, positioned between two insert panels 12 onto the back panel 10. The partition 14 comprises a base 34 and protrusive wall 36 with a cap 38. Cap 38 is configured to be gripped by a hand of the user that wants to replace the panels.

When placing the insert panels 12 onto the back panel 10, the base 34 of partition 14 is positioned between the back side 11 of the insert panels 12 and the back panel 10, and the protrusive wall 36 is positioned between adjacent insert panels 12. In an embodiment with a metallic back panel 10, magnetic connectors 16 can be used to connect the back side 11 of the insert panels 12 onto the metallic back panel 10.

In the event that information displayed on an insert panel 12 needs to be changed, an adjacent partition 14 can be pulled with minimal force by gripping the cap 38 (overcoming the magnetic pull between the insert panel 12 and the back panel 10), so as to physically raise the two adjacent insert panels 12. For insertion of a new insert panel 12, the base 34 of partition 14 can be initially positioned underneath one insert panel 12 so that the new insert panel 12 can be also placed adjacent to the partition 14 and with the back side 11 onto the base 34.

In a further embodiment, at least one insert panel is distinguished from the other insert panels with a differently shaped partition. The differently shaped partition can be used to distinguish between the insert panels in cases where they display different types of information. For example, an insert panel with the title "Accounting" is distinguished by the differently shaped partition from other insert panels listing the personnel. In a similar way (for this example) all department signs may have the name of the department distinguished by the differently shaped partition, and thereby characterizing this type of signs.

Figure 4A:
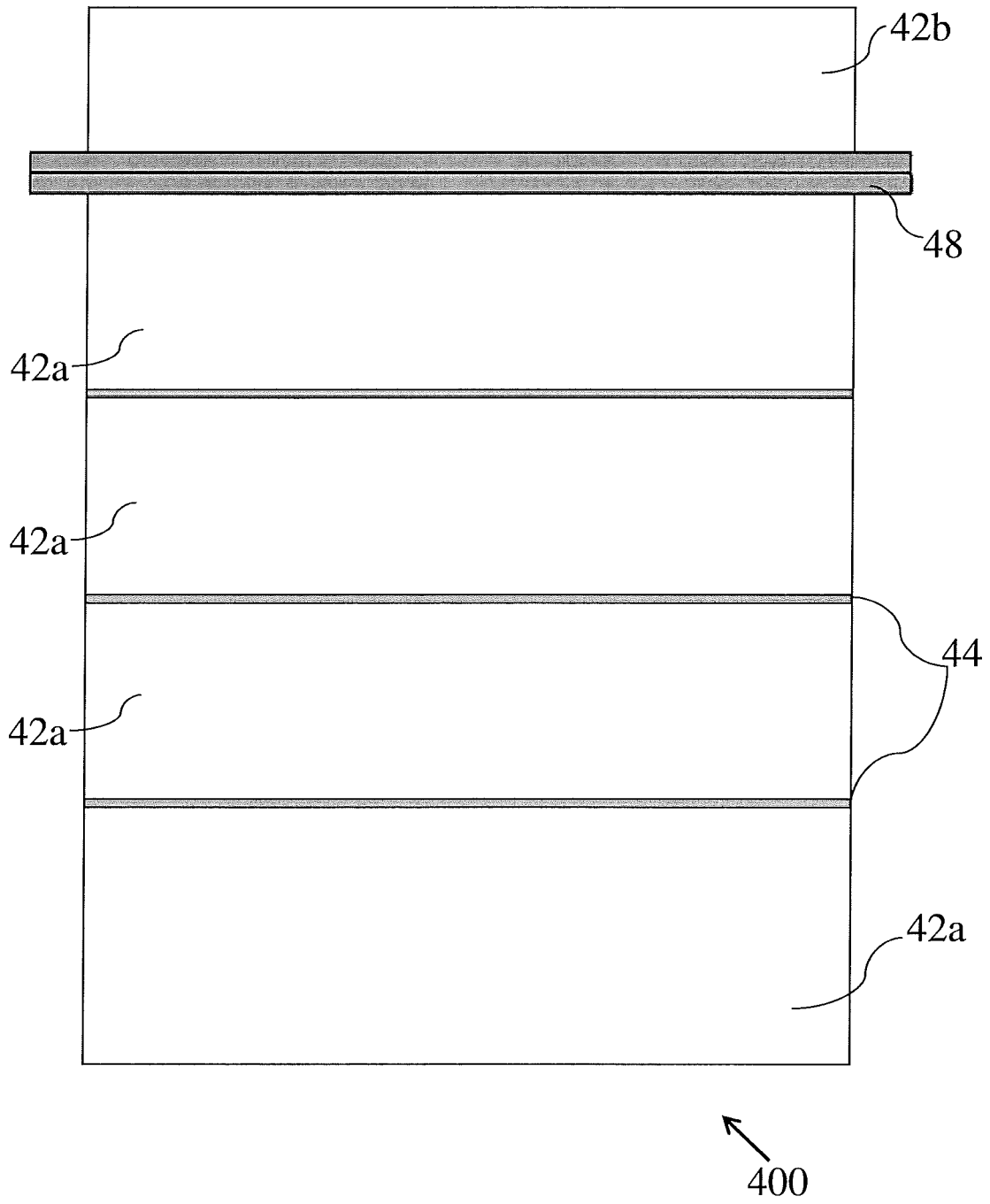
FIG. 4A schematically illustrates a front view of a changeable sign system with an additional partition as a characterization element, according to an exemplary embodiment.
Figure 4B:
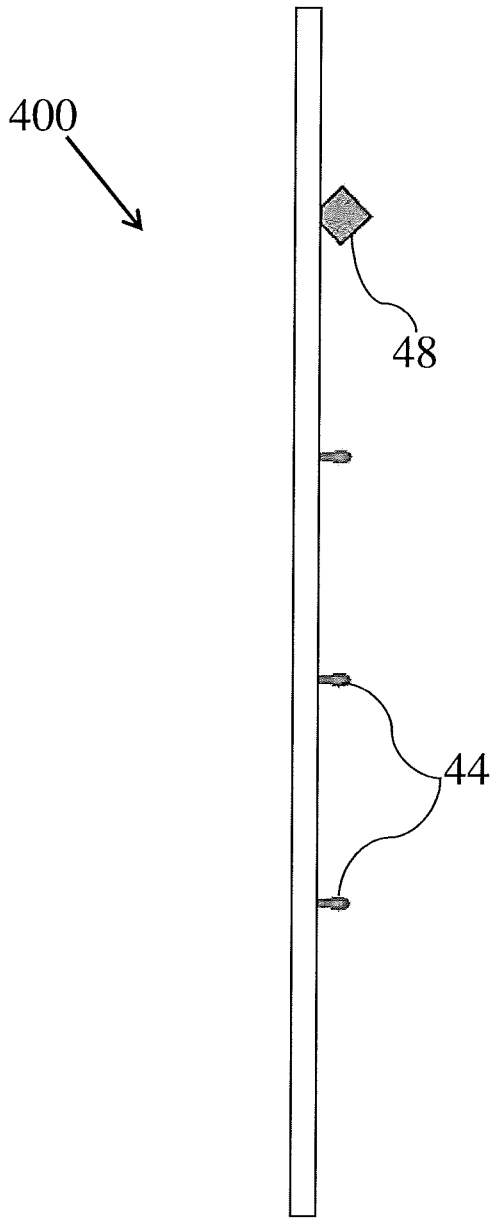
FIG. 4B shows a side view of the changeable sign system from FIG. 4A, according to an exemplary embodiment.
Figure 5A:
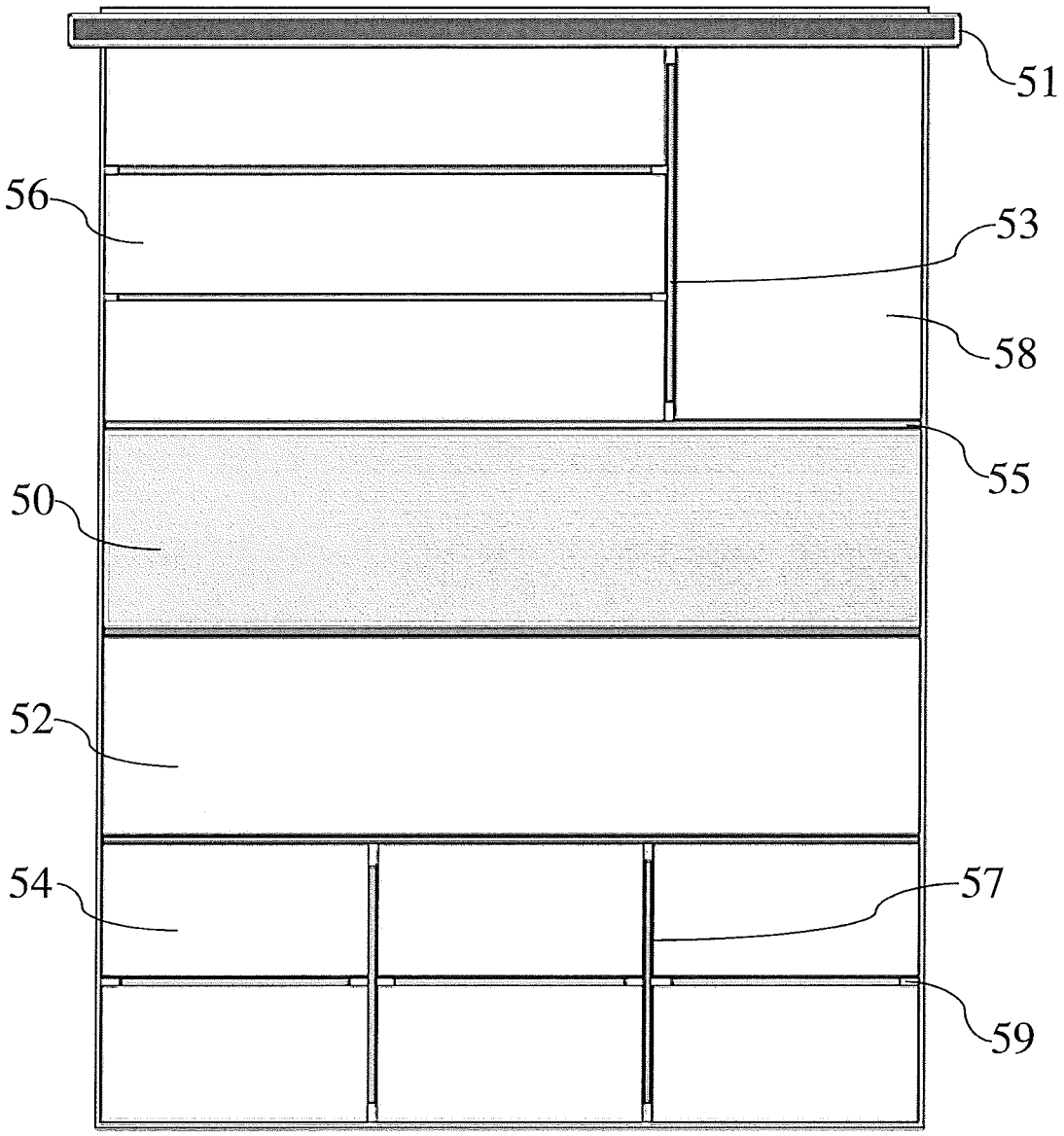
FIG. 5A schematically illustrates an example of a changeable sign system with differently sized partitions and insert panels, according to an exemplary embodiment.
Figure 5B:
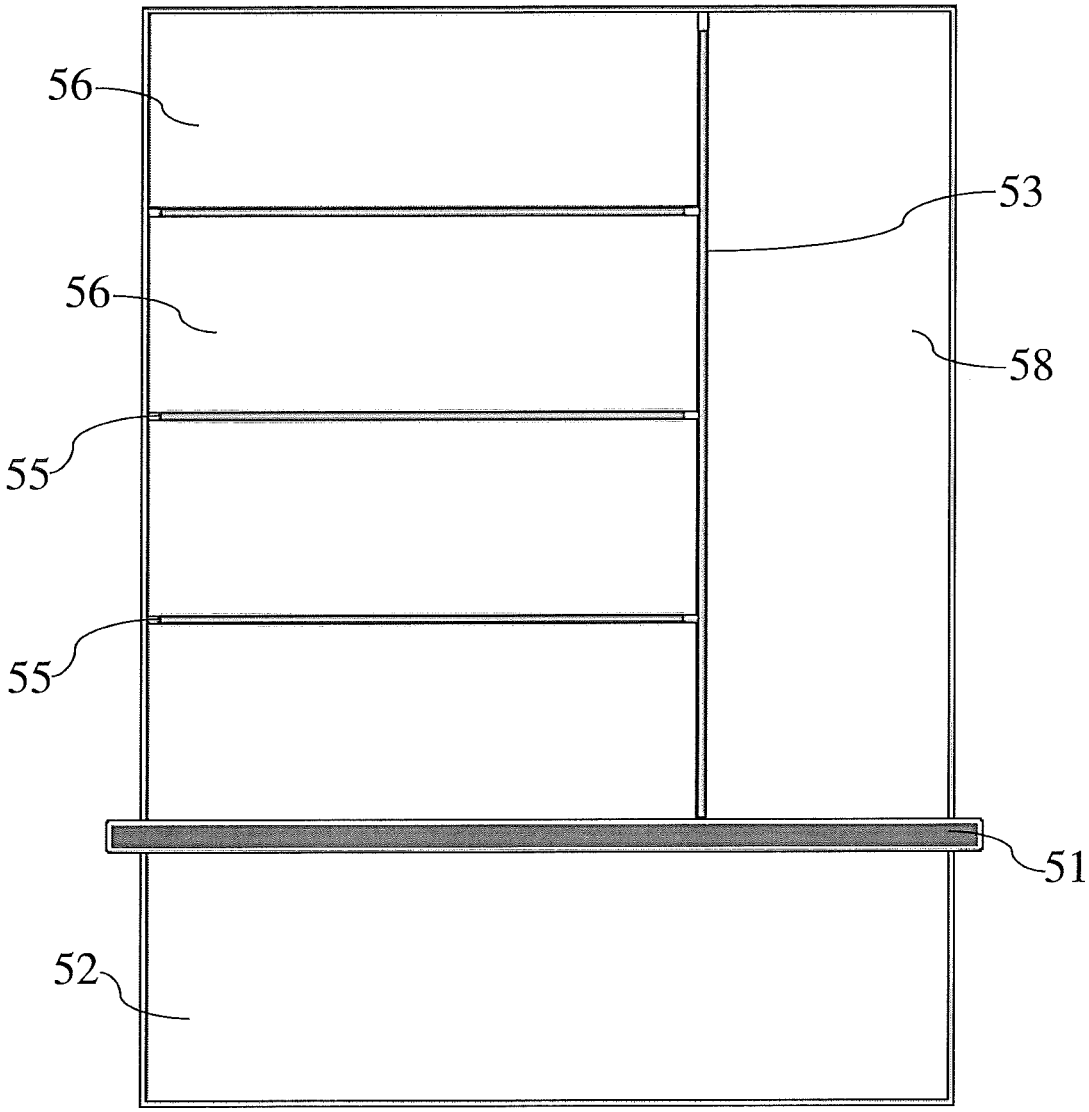
FIG. 5B schematically illustrates another example of a changeable sign system with differently sized partitions and insert panels, according to an exemplary embodiment.
Figure 5C:
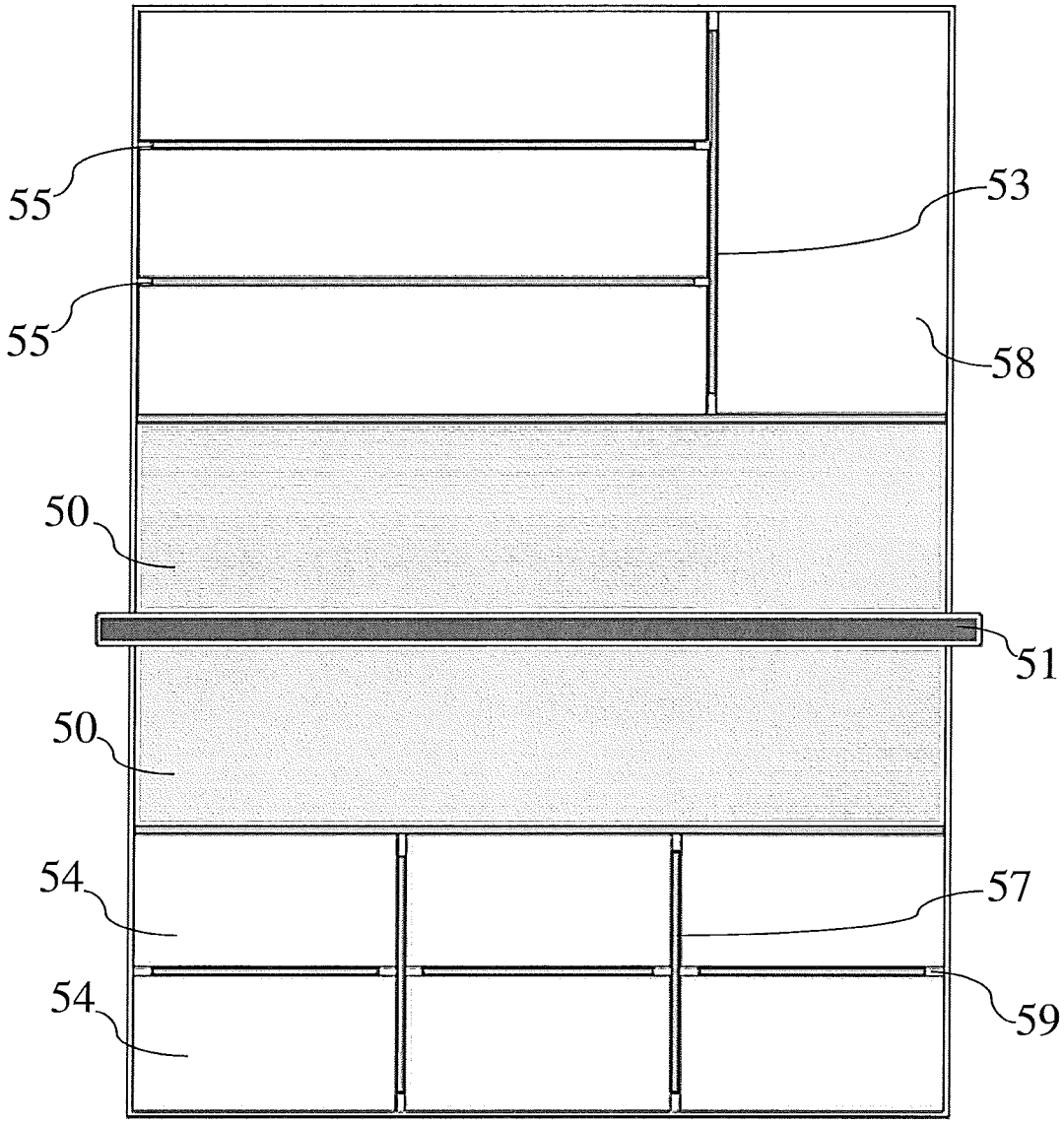
FIG. 5C schematically illustrates an additional example of a changeable sign system with differently sized partitions and insert panels, according to an exemplary embodiment.
Figure 5D:
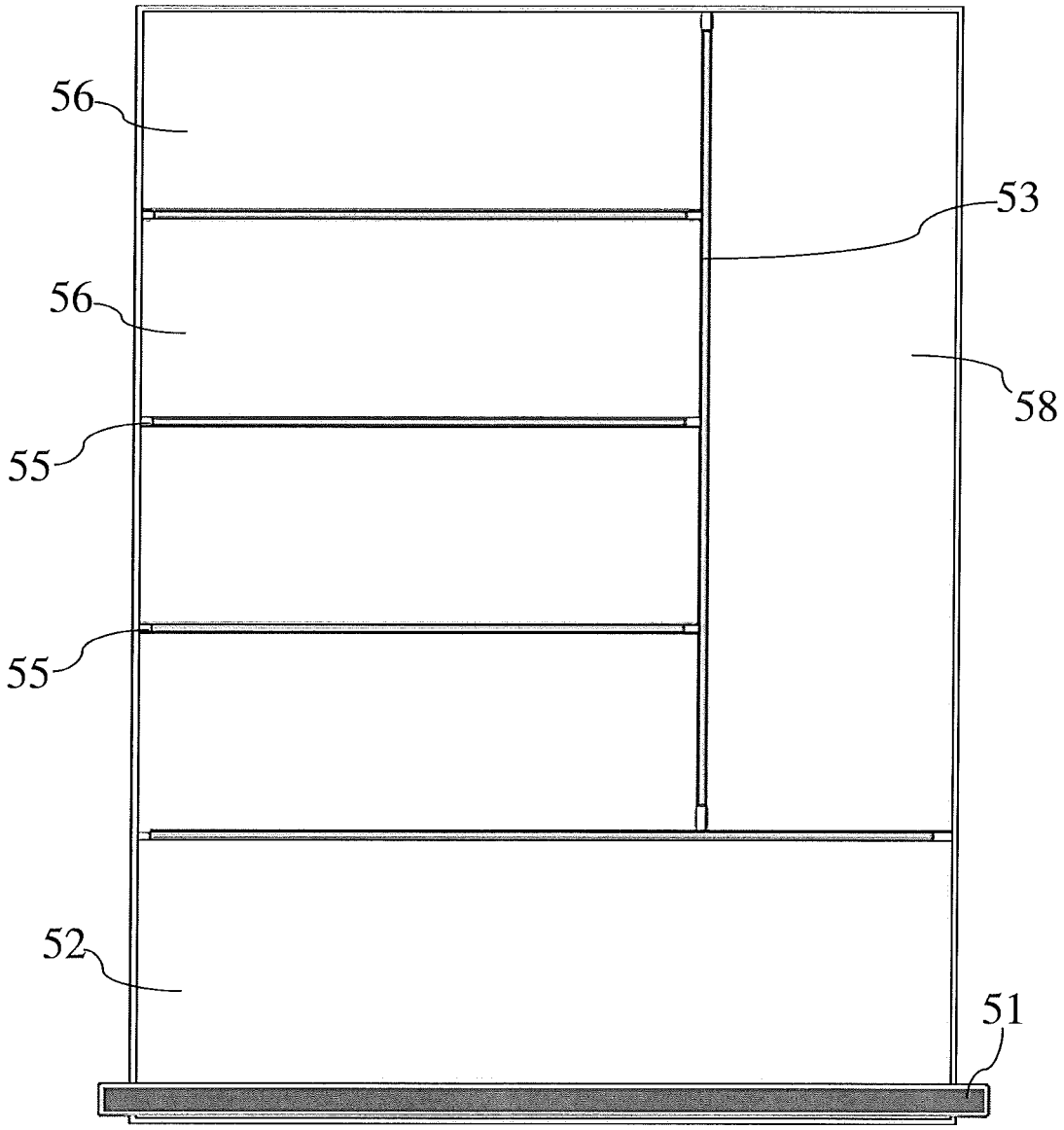
FIG. 5D schematically illustrates a further example of a changeable sign system with differently sized partitions and insert panels, according to an exemplary embodiment.

FIG. 4A and FIG. 4B show a front view and a side view, respectively, of a changeable sign system 400 with a differently shaped partition 48 as a characterization element. Insert panel 42*b* is distinguished from the other insert panels 42*a*, with the characterization element 48. The shape of the characterization element 48 is different from the shape of the other partitions 44 (being larger in size and possibly extending beyond the boundaries of the sign 400 and partitions 44), and thereby distinguishing the adjacent insert panel 42*b* from the other insert panels 42*a*.

In a further embodiment, the changeable sign system can also comprise differently sized partitions and insert panels according to specific requirements of each sign, where each partition or insert panel can be easily replaced.

FIGS. 5A-5D schematically illustrate some examples of changeable sign systems with differently sized partitions (51, 53, 55, 57, and 59) and also differently sized insert panels (50, 52, 54, 56, and 58). An insert panel 50 can be coated with a different material or a different background color in order to be distinguished from other standard insert panels 52. Furthermore, some insert panels 54, 56, 58 can also have heights or lengths different than standard insert panel 52. Additionally, a partition 51 can be made from a different material or coated with a different color to be distinguished from other partitions 55, and some partitions 53, 57, and 59 can also have different lengths than standard partitions 55.

Using partitions and insert panels of different shapes and/or sizes and/or colors, the changeable sign system described above may be arranged in multiple ways according to individual requirements for each sign. As every part of the changeable sign system may be easily replaced, the sign can also be rearranged (for instance replacing one insert panel with three smaller insert panels) when required.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub combination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A modular sign inserts system, comprising:

a back panel;

at least two insert panels adjacently arranged on said back panel, each insert panel having a front side and a back side wherein said back side is placed onto said back panel and said front side of at least one of said at least two insert panels displays information;

at least one partition to be removably placed between two adjacent insert panels, wherein said back side of the insert panels is removably connected to said back panel, and wherein the at least one partition comprises a base configured to be positioned between the back side and the back panel.

2. The modular sign system of claim 1, further comprising a plurality of connectors attached to said back side for connecting said at least one insert panel to the back panel.

3. The modular sign system of claim 2, wherein the back panel is metallic and said plurality of connectors is magnetic.

4. The modular sign system of claim 2, wherein the back panel is magnetic and said plurality of connectors is metallic.

5. The modular sign system of claim 1, wherein said back panel is metallic and said at least two insert panels are magnetic.

6. The modular sign system of claim 1, wherein the at least one partition further comprises a protrusive wall positioned between said two adjacent insert panels.

7. The modular sign system of claim 6, wherein the at least one partition further comprises a cap.

8. The modular sign system of claim 1, wherein at least one of the insert panels has a shape different from shapes of other insert panels.

9. The modular sign system of claim 1, wherein at least one of the insert panels has a size that is different from sizes of other insert panels.

10. The modular sign system of claim 1, wherein at least one of the insert panels has a color that is different from colors of other insert panels.

11. The modular sign system of claim 1, wherein at least one partition has a size that is different from sizes of other partitions.

12. The modular sign system of claim 1, wherein at least one partition has a shape different from shapes of other partitions.

13. The modular sign system of claim 1, wherein at least one partition has a color that is different from colors of other partitions.

14. A method for assembling a changeable modular sign insert system, comprising:

providing a back panel;

providing at least two insert panels, each insert panel has a back side configured to removably connect to said back panel and a front side configured to display information;

adjacently arranging said at least two insert panels onto said back panel so that the back side is connected to said back panel; and placing at least one partition of a plurality of partitions between adjacent insert panels, wherein the at least one partition comprises a base configured to be positioned between the back side and the back panel.

15. The method of claim 14, further comprising providing a plurality of connectors attached to the back side of the insert panels wherein said plurality of connectors are removable connected to said back panel.

16. The method of claim 14, wherein said at least one partition comprises a protrusive wall that is positioned between adjacent insert panels.

17. The method of claim 14, further comprising:

providing a replacement insert panel having a back side and a front side, wherein said front side displays information;

gripping one of the partitions adjacent to an insert panel to be replaced and removing it from between the adjacent insert panels to release the insert panel to be replaced from the back panel;

assembling the replacement insert panel to the back panel; and re-assembling said one of the partitions adjacent to the insert panel to be replaced.

18. The method of 15, wherein the back panel is metallic and the plurality of connectors are magnetic or vice versa.

19. A modular sign insert kit, comprising:

a back panel;

at least two insert panels, each insert panel having a back side and a front side, wherein at least one front side is configured to allow displaying information and said back side is removably connectable to said back panel; and at least one partition is configured to allow separation between insert panels adjacently placed, wherein the at least one partition has a base configured to be positioned between the back side and the back panel.

20. The modular kit of claim 19, further comprising a plurality of connectors, each connector being configured to allow attachment of the back side to the back panel.

* * * * *